US008487022B2

(12) United States Patent
Lennartz et al.

(10) Patent No.: US 8,487,022 B2
(45) Date of Patent: Jul. 16, 2013

(54) COMPOSITION FOR SURFACE COLOURATION OF PAPER

(75) Inventors: Michael Lennartz, Lörrach (DE); Charles Hunger, Ettingen (CH); Asko Olavi Karppi, Turku (FI)

(73) Assignee: BASF SE, Ludwigshafen (DE)

( * ) Notice: Subject to any disclaimer, the term of this patent is extended or adjusted under 35 U.S.C. 154(b) by 473 days.

(21) Appl. No.: 12/087,805

(22) PCT Filed: Jan. 17, 2007

(86) PCT No.: PCT/EP2007/050427

§ 371 (c)(1),
(2), (4) Date: May 26, 2010

(87) PCT Pub. No.: WO2007/085553

PCT Pub. Date: Aug. 2, 2007

(65) Prior Publication Data

US 2010/0285324 A1 Nov. 11, 2010

(30) Foreign Application Priority Data

Jan. 26, 2006 (EP) ..... 06100864

(51) Int. Cl.
*C08L 3/00* (2006.01)
*B32B 27/10* (2006.01)

(52) U.S. Cl.
USPC ..... 524/47; 428/514

(58) Field of Classification Search
USPC ..... 524/47
See application file for complete search history.

(56) References Cited

U.S. PATENT DOCUMENTS

| | | | | |
|---|---|---|---|---|
| 4,835,212 | A | 5/1989 | Degen et al. | 524/734 |
| 4,855,343 | A | 8/1989 | Degen et al. | 524/47 |
| 5,131,981 | A | 7/1992 | Hahn et al. | 162/162 |
| 5,498,648 | A | 3/1996 | De Clercq et al. | 524/47 |
| 6,426,381 | B1 | 7/2002 | Konig et al. | 524/734 |
| 6,753,377 | B1 * | 6/2004 | Niinikoski et al. | 524/734 |
| 2003/0005527 | A1 | 1/2003 | Deckers et al. | 8/536 |
| 2007/0266894 | A1 * | 11/2007 | Davenport et al. | 106/206.1 |

FOREIGN PATENT DOCUMENTS

| | | |
|---|---|---|
| WO | 00/46264 | 8/2000 |
| WO | 03/004766 | 1/2003 |
| WO | 2004/035925 | 4/2004 |
| WO | 2004/090228 | 10/2004 |

OTHER PUBLICATIONS

Patent abstracts of Japan of JP 04 082993.

* cited by examiner

*Primary Examiner* — Hui Chin
(74) *Attorney, Agent, or Firm* — Drinker Biddle & Reath

(57) ABSTRACT

The invention relates to a composition for surface coloration of paper web comprising a) from 0.1 to 30% by weight, based on the total weight of the composition, of a coloring pigment, b) from 0.1 to 20% by weight, based on the total weight of the composition of a starch/latex copolymer, characterized in that, in addition to starch, the monomeric components that are copolymerized comprise i) styrene or a substituted styrene, ii) an acrylate and/or methacrylate and, optionally, iii) one or more further ethylenically unsaturated monomers, c) from 0 to 20% by weight, based on the total weight of the composition, of starch or a starch derivative, d) from 0 to 10% by weight, based on the total weight of the composition of one or more auxiliaries and e) water to complete to 100% by weight, based on the total weight of the composition.

9 Claims, No Drawings

COMPOSITION FOR SURFACE COLOURATION OF PAPER

This application is the National Stage of International Application No. PCT/EP2007/050427, filed Jan. 17, 2007, which claims priority to EP 06100864.5, filed Jan. 26, 2006.

The present invention relates to a composition for surface colouration of paper web comprising a colouring pigment, a synthetic starch/latex copolymer and, optionally, further additives and the use thereof for surface colouration of said paper web.

Despite the fact that the economical advantages of surface colouration of paper have long been recognized, in practice, surface colouration is not widespread when compared with stock dyeing. The main reason for this situation (see, for example, "On-machine surface coloration", A. S. Tindal, Surface Application of Paper Chemicals, 1997, 175-191) is that surface coloured paper generally exhibits poor bleed fastness when contacted with liquids such as water, alcohol or beverages.

One attempt to overcome this problem has been disclosed in WO 03/004766, whereby a dye composition containing a binder and thickener, which is a polyvinylpyrrolidone derivative, is applied to the paper surface. Preferably, the paper surface is treated with a fixing agent prior to the dyeing process in order to improve bleed fastness, but no concrete values are given to indicate the effectiveness of this approach.

A further approach to overcome the bleeding problems associated with surface colouration of paper has been disclosed in WO 04/090228. This document discloses a composition for controlling the bleed fastness of organic colouring pigments in paper coatings comprising a colouring pigment and, essentially, a binder. Suitable binders are selected from an extremely wide variety of entities, but most preferred and efficient are binders based on copolymers of starch with styrene/butadiene latex. However, relatively high quantities of binder are required to achieve the desired bleed fastness and it has also been observed that the resulting dyeings lack sufficiently high quality for certain applications, due to, for example, excessive mottling and lack of homogeneity.

Consequently, there is a need for a system for surface colouration of paper in which the disadvantages of previous compositions are overcome.

It has now been found that compositions comprising colouring pigments and particular starch based copolymer binders result in dyeings which, in addition to exhibiting excellent bleed fastness at relatively low application concentrations, are of exceptionally high quality, in particular, with respect to mottling, colour strength and homogeneity.

Therefore, a composition comprising a) from 0.1 to 30%, preferably from 1 to 25%, by weight, based on the total weight of the composition, of a colouring pigment,
b) from 0.1 to 20%, preferably from 0.5 to 10% and most preferably from 1 to 5%, by weight, based on the total weight of the composition of a starch/latex copolymer, characterized in that, in addition to starch the monomeric components that are copolymerized comprise
   i) styrene or a substituted styrene,
   ii) an acrylate and/or methacrylate and, optionally,
   iii) one or more further ethylenically unsaturated monomers,
c) from 0 to 20%, preferably from 0 to 10%, by weight, based on the total weight of the composition, of starch or a starch derivative,
d) from 0 to 10% by weight, based on the total weight of the composition of one or more auxiliaries and
e) water to complete to 100% by weight, based on the total weight of the composition has been found.

With regard to the colouring pigment, component a) of the composition, this may be selected from any colouring pigment as described in the Colour Index International, fourth online edition (Society of Dyers and Colourists and American Association of Textile Chemists and Colorists 2002) under the designations C.I. Pigment Yellows 1 to 221, C.I. Pigment Oranges 1 to 81, C.I. Pigment Reds 1 to 283, C.I. Pigment Violets 1 to 53, C.I. Pigment Blues 1 to 81, C.I. Pigment Greens 1 to 56, C.I. Pigment Browns 1 to 47 and C.I. Pigment Blacks 1 to 35.

Preferably, the colouring pigment is selected from C.I. Pigment Yellow 1, 3, 12, 13, 14, 17, 34, 42, 51, 53, 62, 74, 83, 93, 95, 109, 110, 111, 128, 129, 139, 147, 168, 174, 184, 188, 191:1 and 199, C.I. Pigment Orange 5, 13, 16, 23, 34, 49, 61, 63, 64, 71, 73, and 81, C.I. Pigment Red 2, 4, 5, 12, 23, 38, 48:1, 48:2, 48:3, 48:4, 49:1, 52:2, 53:1, 57, 57:1, 81, 101, 104, 110, 112, 144, 146, 166, 177, 181, 184, 185, 202, 206, 214, 220, 221, 254, 255, 264, 270, 272, 282 and 283, C.I. Pigment Violet 3, 19, 23, and 37, C.I. Pigment Blue 1, 15, 15:1, 15:2, 15:3, 15:4, 29, 60 and 66, C.I. Pigment Green 60 and 66, C.I. Pigment Brown 23 and 24 and from C.I. Pigment Black 7, 10 and 34.

The ratios of starch to unsaturated monomers for the preparation of the starch/latex copolymer, component b) of the composition, generally lie within the range of i) from 5 to 50%, preferably from 5 and 40%, by weight of starch and
ii) from 50 to 95%, preferably from 60 to 95%, by weight of the monomeric components, whereby the copolymers may advantageously be utilized in the form of aqueous dispersions. These polymer dispersions generally contain between 20 and 50%, preferably between 25 and 35%, dry weight of solids.

Aqueous dispersions of similar copolymers have been described in WO 00/46264, which document also discloses a process for their preparation.

Polymerisable starch or starch derivatives suitable for incorporating into component b) and also as the optional component c) of the composition of the invention may include practically all thinned starches of plant origin including starches from corn, wheat, potatoes, tapioca, rice, sago and sorghum. Waxy and high amylose starches may also be suitable. The starches can be thinned by acid hydrolysis, oxidative hydrolysis or enzymatic degradation. Further derivatized starches also suitable include those such as starch ethers, starch esters, cross-linked starches, oxidized starches and chlorinated starches, for example, carboxymethyl cellulose and hydroxyethyl methyl cellulose. Typical examples are the commercially available amylopectin, dextrin and, as a typical example of oxidized starch, Perfectamyl® 4692.

However, component b) of the composition of the invention is preferably obtained by copolymerization of a degraded, oxidized anionic starch.

In addition to the starch component of the copolymer, component b) of the composition of the invention, the individual monomers and their relative amounts are critical for providing the advantageous properties provided by the invention.

Thus, in a further preferred aspect, the starch/latex copolymer, component b) of the composition of the invention, is obtained, preferably by emulsion polymerization of a mixture of monomers consisting of i) from 20 to 40% by weight of styrene or a substituted styrene,
ii) from 20 to 50% of an acrylate or a methacrylate and
iii) from 5 to 20% by weight of one or more further ethylenically unsaturated monomers in the presence of from 15 to 40%, preferably from 15 to 35%, by weight of starch, Substituted styrenes may include, for example, α-methyl styrene, or styrenes substituted in the phenyl ring by alkyl groups, such as methyl, halogens, such as chlorine or alkoxy groups such as methoxy. However, styrene itself is the most preferred component.

Acrylates or methacrylates are preferably lower alkyl esters such as methyl, ethyl, n- or isopropyl and n-, iso-, sec- or tert-butyl esters or their mixtures, n-butyl acrylate being the most preferred component.

With regard to the third ethylenically unsaturated monomer, this may be selected from a wide variety of compounds containing one single unsaturated double bond, i.e. excluding dienes of previously disclosed starch/latex copolymers such as 1,3-butadiene or isoprene. Examples of suitable ethylenically unsaturated monomers are hydroxylated alkyl methacrylates, alkyl vinyl ketones, substituted acrylamides, methacrylic acid, N-methylol acrylamide, 2-hydroxyethyl acrylate, crotonic acid, itaconic acid, fumaric acid, maleic acid, maleic anhydride, vinyl halides, vinylidene halides, vinyl esters, vinyl ethers, vinyl carbazole, N-vinyl pyrrolidone, vinyl pyridine, ethylene, propylene, isobutylene, vinyl triethoxy silane and triphenyl vinyl silane. Preferred monomers include dimethylamino ethyl acrylate, dimethylamino propyl acrylamide, vinyl acetate, acrylic acid, acrylamide, maleic anhydride, monovinyl silicon compounds including vinyl trimethyl silane, ethyl vinyl ether, butyl vinyl ether, 2-ethylhexyl acrylate vinylidine chloride, butyl vinyl ether and, especially acrylonitrile.

In a most preferred aspect, the starch/latex copolymer, component b) of the composition of the invention is a product obtained by emulsion polymerization of i) from 20 to 40% by weight of styrene, ii) from 20 to 50% by weight of a $C_1$-$C_4$alkylacrylate, especially n-butyl acrylate and iii) from 5 to 20% by weight of vinyl acetate or, especially, acrylonitrile, in the presence of from 15 to 35% by weight of an oxidatively degraded anionic starch, in the form of an aqueous dispersion having a dry content of between 25 and 35% by weight.

Furthermore, the composition of the invention may contain further auxiliaries selected from fixing agents, dispersants, additional binder and binder resins, insolubilizing and/or crosslinking agents, anionic, cationic and neutral polymers, wet-strength agents, antifoams and biocides.

Suitable auxiliaries may, for example, include polyethyleneimines and derivatives thereof, inorganic salts such as sodium chloride, magnesium chloride and potassium chloride, alum, polydiallyl dimethyl ammonium chloride, polyamide amine resins, polyvinyl alcohol, polyvinyl pyrrolidone and homo and copolymers thereof, polyesters and polyethers, glyoxal derivatives, monoethanolamine, acrylic acid/alkyl acrylate copolymers and styrene/acrylate copolymers.

The composition of the invention is suitable for use in surface colouration of paper web after sheet formation.

Preferably, the composition is applied to the paper web after it has been dried to 80 to 95% in the size press or by means of an on-line coater. Alternatively, the composition can be applied once the paper has been fully dried in an off-machine coating process, such as by spraying, curtain coating or by conventional coating processes. Such application processes are described in "Pigment Coating and Surface Sizing of Papers" by E. Lehtinen, published by Tappi International, 2000.

Consequently, in a still further aspect, the invention relates to a method for the surface colouration of paper by applying to the paper surface a composition comprising a) from 0.1 to 30% by weight, based on the total weight of the composition, of a colouring pigment, whereby the colouring pigment is in solid form or in the form of a dispersion, in which form many colouring pigments are commercially available, b) from 0.1 to 20% by weight, based on the total weight of the composition of a starch/latex copolymer, characterized in that, in addition to starch, the monomeric components that are copolymerized comprise i) styrene or a substituted styrene, ii) an acrylate and/or methacrylate and, optionally, iii) one or more further ethylenically unsaturated monomers, c) from 0 to 20% by weight, based on the total weight of the composition, of starch or a starch derivative, d) from 0 to 10% by weight, based on the total weight of the composition of one or more auxiliaries and e) water to complete to 100% by weight, based on the total weight of the composition and also to paper, which has been treated with a composition of the invention or according to the method above.

Where, in the above method, the pigment is used in the form of a dispersion, addition of the starch/latex copolymer generally suffices to achieve the desired effect, i.e. bleed fastness of the resulting dyed paper web, without addition of further starch binder, component c) of the composition, which is clearly advantageous.

The inventive compositions comprising colouring pigments and particular starch based copolymer binders result in dyeings exhibiting excellent bleed fastness at relatively low application concentrations and which are of exceptionally high quality, in particular, with respect to colour strength and homogeneity, including lack of mottling, as opposed to previously known combinations.

The following examples further illustrate the invention, without intending to be restrictive in nature; parts and percentages are by weight unless otherwise indicated.

EXAMPLES

I. Size Press Application

Base Paper:

The base paper used for the application was fabricated on a laboratory paper machine at UMIST, Manchester, UK from a 70/30 mixture of hard and soft woods pulp beaten to 35° SR, containing 10% retained clay (plus 1% calcium carbonate) filler, 0.4% Hercat® 27JP4 pseudo neutral size, 1% alum and 0.02% Percol® 230 retention agent. The resulting paper has a base weight of 103 g/m$^2$ and a Cobb value of 95 g/m$^2$.

Application:

Defined amounts of pigment and copolymer (see Table 1) are added to 44 g of a 10% aqueous solution of size press starch (Perfectamyl® 4692) and the mixture made up to 100 g with water, where after the mixture is applied to the base paper in a Mathis size press running at 5 m/min., with a pressure of 200 kPas and at a temperature of 50° C. After drying, the resulting colour strengths of the dyeings are then measured, whereby the values given in Tables 1 and 2 are corrected, taking the reference dyeing without copolymer addition as standard (100%), to take into account the amount of colorant actually residing on the paper surface. The absolute measured values of colour strength are given in parentheses.

Additionally, the bleed fastness of the dyeings towards water and 50% alcohol/water are measured by firstly moistening the dyeing with deionised water and alcohol/water respectively and placing the moist dyeings between two sheets of white filter papers which are moistened with deionised water and alcohol/water respectively. The resulting sandwich is placed between two glass plates weighted with a 1 kg weight. After 1 hour at room temperature, the individual sheets are dried and the bleed fastness assessed by means of the grey scale, whereby a value between 1 (very strong bleeding) and 5 (zero bleeding) is obtained.

The results of the measurements are summarized in the following Table 1:

TABLE 1

| Example No. | %/C.I. Pigment | % Copolymer | % Pick-up | % Colour Strength | Bleed Water PF[1]/GF[2] | Bleed Alcohol PF/GF |
|---|---|---|---|---|---|---|
| 1 | 7/Violet 23 | None | 48.8 | 100 | 2/2 | 5/5 |
| 2 | 7/Violet 23 | 2.2/Polymer A[3] | 51.6 | 76.5 (81) | 4/4-5+ | 5/5 |
| 3 | 7/Violet 23 | 4.3/Polymer A | 51.6 | 76.6 (80) | 4-5/4-5 | 5/5 |
| 4 | 7/Violet 23 | 6.4/Polymer A | 51.9 | 75.7 (84) | 5/5 | 5/5 |
| 5 | 7/Violet 23 | 5/Pensize[4] 730 | 44.2 | 91.7 (83) | 4/4 | 5/5 |
| 6 | 7/Violet 23 | 10/Pensize 730 | 45.7 | 96.1 (90) | 4-5/4-5 | 5/5 |
| 7 | 7/Violet 23 | 15/Pensize 730 | 41.6 | 102.0 (87) | 4-5/4-5 | 5/5 |
| 8 | 7/Violet 23 | 2/Raiprint 501[5] | 46.6 | 60.1 (58) | 3-4/3-4 | 5/5 |
| 9 | 7/Violet 23 | 4/Raiprint 501 | 46.9 | 57.2 (55) | 4-5/4-5+ | 5/5 |
| 10 | 7/Violet 23 | 6/Raiprint 501 | 46.3 | 61.2 (58) | 4-5/4-5 | 5/5 |
| 11 | 7/Violet 23 | 2.2Raiprint 300[6] | 51.6 | 90.2 (93) | 3/3-4 | 5/5 |
| 12 | 7/Violet 23 | 4.4/Raiprint 300 | 47.5 | 85.2 (83) | 4+/4-5 | 5/5 |
| 13 | 7/Violet 23 | 6.6Raiprint 300 | 44.7 | 76.5 (70) | 4-5/4-5+ | 5/5 |
| 14 | 8/Blue 15:1 | None | 42.9 | 100 | 2-3/2 | 5/5 |
| 15 | 8/Blue 15:1 | 2.2/Polymer A | 37.7 | 104.7 (92) | 4/4 | 5/5 |
| 16 | 8/Blue 15:1 | 4.3/Polymer A | 36.7 | 112.2 (96) | 4-5+/4-5+ | 5/5 |
| 17 | 8/Blue 15:1 | 6.4/Polymer A | 36.5 | 112.9 (96) | 5/5 | 5/5 |
| 18 | 8/Blue 15:1 | 5/Pensize 730 | 37.3 | 73.8 (64) | 4-5/4-5 | 5/5 |
| 19 | 8/Blue 15:1 | 10/Pensize 730 | 33.5 | 93.5 (73) | 4-5/4-5 | 5/5 |
| 20 | 8/Blue 15:1 | 15/Pensize 730 | 33.3 | 105.6 (82) | 4-5/4-5 | 5/5 |
| 21 | 8/Blue 15:1 | 2/Raiprint 501 | 41.2 | 86.5 (83) | 3-4+/4 | 5/5 |
| 22 | 8/Blue 15:1 | 4/Raiprint 501 | 37.6 | 96.0 (84) | 4-5/4-5+ | 5/5 |
| 23 | 8/Blue 15:1 | 6/Raiprint 501 | 39.0 | 96.8 (88) | 4-5+/4-5+ | 5/5 |
| 24 | 8/Blue 15:1 | 2.2/Raiprint 300 | 40.9 | 97.7 (93) | 4/4 | 5/5 |
| 25 | 8/Blue 15:1 | 4.4/Raiprint 300 | 38.4 | 86.1 (77) | 5/5 | 5/5 |
| 26 | 8/Blue 15:1 | 6.6/Raiprint 300 | 34.9 | 88.5 (72) | 5/5 | 5/5 |
| 27 | 7/Red 2 | None | 38.5 | 100 | 3/3 | 5/5 |
| 28 | 7/Red 2 | 2.2/Polymer A | 44.2 | 92.3 (106) | 4-5+/4-5+ | 5/5 |
| 29 | 7/Red 2 | 4.3/Polymer A | 42.4 | 95.2 (105) | 5/5 | 5/5 |
| 30 | 7/Red 2 | 6.4/Polymer A | 44.9 | 92.5 (108) | 5/5 | 5/5 |
| 31 | 7/Red 2 | 5/Pensize 730 | 34.1 | 77.8 (69) | 4-5/4-5 | 5/5 |
| 32 | 7/Red 2 | 10/Pensize 730 | 35.8 | 87.1 (81) | 5/5 | 5/5 |
| 33 | 7/Red 2 | 15/Pensize 730 | 30.5 | 118.4 (94) | 5/5 | 5/5 |
| 34 | 7/Red 2 | 2/Raiprint 501 | 38.0 | 83.1 (82) | 4-5/4-5 | 5/5 |
| 35 | 7/Red 2 | 4/Raiprint 501 | 35.5 | 93.1 (86) | 5/4-5+ | 5/5 |
| 36 | 7/Red 2 | 6/Raiprint 501 | 39.3 | 87.2 (89) | 5/4-5+ | 5/5 |
| 37 | 7/Red 2 | 2.2/Raiprint 300 | 40.5 | 87.4 (92) | 4-5+/4-5+ | 5/5 |
| 38 | 7/Red 2 | 4.4/Raiprint 300 | 36.2 | 72.3 (68) | 5/5 | 5/5 |
| 39 | 7/Red 2 | 6.6/Raiprint 300 | 35.0 | 77.0 (70) | 5/5 | 5/5 |
| 40 | 8/Yellow 1 | None | 38.7 | 100 | 3+/2-3 | 5/5 |
| 41 | 8/Yellow 1 | 2.2/Polymer A | 39.4 | 89.4 (91) | 5/5 | 5/5 |
| 42 | 8/Yellow 1 | 4.3/Polymer A | 36.7 | 102.1 (97) | 5/5 | 5/5 |
| 43 | 8/Yellow 1 | 6.4/Polymer A | 37.7 | 101.5 (99) | 5/5 | 5/5 |
| 44 | 8/Yellow 1 | 5/Pensize 730 | 41.0 | 62.3 (66) | 4-5+/4-5+ | 5/5 |
| 45 | 8/Yellow 1 | 10/Pensize 730 | 32.5 | 85.6 (72) | 5/5 | 5/5 |
| 46 | 8/Yellow 1 | 15/Pensize 730 | 32.1 | 103.6 (86) | 5/5 | 5/5 |
| 47 | 8/Yellow 1 | 2/Raiprint 501 | 38.6 | 71.3 (71) | 4-5+/4-5 | 5/5 |
| 48 | 8/Yellow 1 | 4/Raiprint 501 | 37.7 | 73.8 (72) | 5/5 | 5/5 |
| 49 | 8/Yellow 1 | 6/Raiprint 501 | 40.0 | 78.4 (81) | 5/5 | 5/5 |
| 50 | 8/Yellow 1 | 2.2/Raiprint 300 | 38.0 | 60.2 (59) | 5/5 | 5/5 |
| 51 | 8/Yellow 1 | 4.4/Raiprint 300 | 37.1 | 54.2 (52) | 5/5 | 5/5 |
| 52 | 8/Yellow 1 | 6.6/Raiprint 300 | 32.7 | 41.4 (35) | 5/5 | 5/5 |
| 53 | 5/Black 7 | None | 38.4 | 100 | 4/4 | 5/5 |
| 54 | 5/Black 7 | 2.2/Polymer A | 37.4 | 96.5 (94) | 4-5/4-5 | 5/5 |
| 55 | 5/Black 7 | 4.3/Polymer A | 33.9 | 100.7 (89) | 5/5 | 5/5 |
| 56 | 5/Black 7 | 6.4/Polymer A | 33.7 | 92.2 (81) | 5/5 | 5/5 |
| 57 | 5/Black 7 | 5/Pensize 730 | 40.6 | 31.2 (33) | 3-4/4 | 5/5 |
| 58 | 5/Black 7 | 10/Pensize 730 | 34.5 | 47.8 (43) | 4-5/5 | 5/5 |
| 59 | 5/Black 7 | 15/Pensize 730 | 34.1 | 56.3 (50) | 4-5+/5 | 5/5 |
| 60 | 5/Black 7 | 2/Raiprint 501 | 37.7 | 55.0 (54) | 4-5/4-5 | 5/5 |
| 61 | 5/Black 7 | 4/Raiprint 501 | 34.9 | 64.9 (59) | 4-5/4-5 | 5/5 |
| 62 | 5/Black 7 | 6/Raiprint 501 | 37.0 | 65.5 (63) | 4-5+/5 | 5/5 |
| 63 | 5/Black 7 | 2.2/Raiprint 300 | 41.8 | 27.6 (30) | 4-5/4-5+ | 5/5 |
| 64 | 5/Black 7 | 4.4/Raiprint 300 | 39.8 | 33.8 (35) | 5/5 | 5/5 |
| 65 | 5/Black 7 | 6.6/Raiprint 300 | 40.6 | 23.7 (25) | 5/5 | 5/5 |

[1]PF = Bleed fastness between filter papers;

[2]GF = Bleed fastness between glass fibre sheet

[3]Polymer A is an experimental product obtained by emulsion copolymerization of 25% starch(Raisamyl ® 01121, oxidatively degraded anionic starch), 38.6% styrene, 28.6% n-butyl acrylate and 7.8% acrylonitrile;

[4]Pensize ® 730 is a commercially available aqueous formulation of a starch/styrene/butadiene latex copolymer;

[5]Raiprint ® 501 is a commercially available product obtained by copolymerization of 25% Raisamyl ® 150 EH (a cationic starch), 38.62% styrene, 28.61% n-butylacrylate and 7.76% acrylonitrile;

[6]Raiprint ® 300 is a commercially available product obtained by copolymerization of 20% Raisafix ® 01015 SW (an amphoteric starch), 24.8% styrene, 40% n-butyl acrylate and 15.2% acrylonitrile.

From the above Table 1, the advantages of the experimental Polymer A over the commercial product Pensize 730 are clearly visible. Thus, for example, taking into account the pick-up from the size press bath, it may be calculated that in order to obtain acceptable bleed fastness of 4-5 minimum at comparable depth of colour, with C.I. Pigment Violet 23, 2.22% of Polymer A is required, whilst 4.57% Pensize 730 must be applied. Similar comparisons for C.I. Pigment Blue 15.1 and C.I. Pigment Red 2 result in values of 0.83% as opposed to 5.0% and 0.98% as opposed to 3.58%, respectively.

In addition, the superior efficiency of the experimental polymer A, in general, demonstrates the advantages of this copolymer in comparison to the commercially available Raiprint® products.

Also of note are the results obtained with C.I. Pigment Black 7, whereby solely Polymer A can be seen to produce dyeings of adequate colour strength.

In a further series of experiments, dyeings of the dark shades, violet, blue and red, were examined in greater detail. The results are summarized in the following Table 2:

TABLE 2

| Example No. | %/ C.I. Pigment | % Copolymer | % Pick-up | % Colour Strength | Bleed Water PF[1]/GF[2] | Bleed Alcohol PF/GF |
|---|---|---|---|---|---|---|
| 66 | 7/Violet 23 | None | 58.3 | 100 | 2-3/3-4 | 5/5 |
| 67 | 7/Violet 23 | 1/Polymer A[3] | 52.1 | 95.1 (85) | 4-5/5 | 5/5 |
| 68 | 7/Violet 23 | 1.8/Polymer A | 53.4 | 92.3 (85) | 4-5+/5 | 5/5 |
| 69 | 7/Violet 23 | 5/Polymer A | 53.4 | 95.0 (87) | 5/5 | 5/5 |
| 70 | 7/Violet 23 | 8/Polymer A | 50.9 | 97.3 (85) | 5/5 | 5/5 |
| 71 | 7/Violet 23 | 2/Pensize[4] 730 | 46.3 | 88.0 (70) | 4/4+ | 5/5 |
| 72 | 7/Violet 23 | 3.75/Pensize 730 | 50.9 | 83.6 (73) | 4-5/5 | 5/5 |
| 73 | 7/Violet 23 | 10/Pensize 730 | 42.6 | 109.4 (80) | 5/5 | 5/5 |
| 74 | 7/Violet 23 | 18.75/Pensize 730 | 40.4 | 115.2 (80) | 5/5 | 5/5 |
| 75 | 8/Blue 15:1 | None | 49.4 | 100 | 3/3-4 | 5/5 |
| 76 | 8/Blue 15:1 | 1/Polymer A | 41.7 | 111.4 (94) | 4-5/4+ | 5/5 |
| 77 | 8/Blue 15:1 | 1.8/Polymer A | 40.7 | 115.2 (95) | 4-5+/4-5 | 5/5 |
| 78 | 8/Blue 15:1 | 5/Polymer A | 42.5 | 112.7 (97) | 4-5+/4-5+ | 5/5 |
| 79 | 8/Blue 15:1 | 8/Polymer A | 41.1 | 119.0 (99) | 4-5+/4-5+ | 5/5 |
| 80 | 8/Blue 15:1 | 2/Pensize 730 | 41.0 | 67.5 (56) | 4-5/4+ | 5/5 |
| 81 | 8/Blue 15:1 | 3.75/Pensize 730 | 43.4 | 67.2 (59) | 4-5+/4-5 | 5/5 |
| 82 | 8/Blue 15:1 | 10/Pensize 730 | 38.4 | 95.1 (74) | 5/4-5+ | 5/5 |
| 83 | 8/Blue 15:1 | 18.75/Pensize 730 | 34.1 | 128.7 (89) | 5/5 | 5/5 |
| 84 | 7/Red 2 | None | 41.0 | 100 | 3-4/4 | 5/5 |
| 85 | 7/Red 2 | 1/Polymer A | 41.2 | 103.4 (104) | 5/5 | 5/5 |
| 86 | 7/Red 2 | 1.8/Polymer A | 40.4 | 102.5 (101) | 5/5 | 5/5 |
| 87 | 7/Red 2 | 5/Polymer A | 41.6 | 103.5 (105) | 5/5 | 5/5 |
| 88 | 7/Red 2 | 8/Polymer A | 41.1 | 112.6 (113) | 5/5 | 5/5 |
| 89 | 7/Red 2 | 2/Pensize 730 | 41.7 | 64.8 (66) | 4-5+/5 | 5/5 |
| 90 | 7/Red 2 | 3.75/Pensize 730 | 41.2 | 68.6 (69) | 5/5 | 5/5 |
| 91 | 7/Red 2 | 10/Pensize 730 | 37.1 | 99.3 (90) | 5/5 | 5/5 |
| 92 | 7/Red 2 | 18.75/Pensize 730 | 36.4 | 102.0 (115) | 5/5 | 5/5 |

[1]to[4], see footnotes at end of Table 1

As in the previous experiments, the quantities of Polymer A required for producing dyeings of acceptable bleed fastness and depth of colour are considerably lower than the quantities of Pensize 730. Thus for example, in the case of C.I. Pigment Violet 23, 0.96% of Polymer A is required, whilst 4.26% of Pensize 730 is necessary. Analogous values with C.I. Pigment Blue 15:1 are 0.73% as opposed to above 3.84% and for C.I. Pigment Red 2, 0.41% as opposed to 3.71% Pensize 730.

Once again, the poor performance of the Pensize® 730 series in terms of color strength and dyeing efficiency is apparent when small or medium amounts of this copolymer are employed.

In one further series of experiments, not only the quantities of copolymer, but also the quantities of pigment were varied. The colour strengths in the Table represent the absolute measured values after drying. The results are summarized in the following Table 3:

TABLE 3

| Example No. | %/ C.I. Pigment | % Copolymer | % Pick-up | % Colour Strength | Bleed Water PF[1]/GF[2] | Bleed Alcohol PF/GF |
|---|---|---|---|---|---|---|
| 93 | 7/Violet 23 | None | 54.8 | 100 | 2-3/3 | 5/5 |
| 94 | 3.5/Violet 23 | 2.6/Polymer A3 | 53.9 | 59 | 5/5 | 5/5 |
| 95 | 7/Violet 23 | 5.2/Polymer A | 48.8 | 85 | 5/5 | 5/5 |
| 96 | 14/Violet 23 | 10.4/Polymer A | 42.2 | 108 | 5/5 | 5/5 |

TABLE 3-continued

| Example No. | %/ C.I. Pigment | % Copolymer | % Pick-up | % Colour Strength | Bleed Water PF[1]/GF[2] | Bleed Alcohol PF/GF |
|---|---|---|---|---|---|---|
| 97 | 21/Violet 23 | 15.6/Polymer A | 39.8 | 137 | 5/5 | 5/5 |
| 98 | 3.5/Violet 23 | 5.3/Pensize[4] 730 | 45.1 | 42 | 4-5+/5 | 5/5 |
| 99 | 7/Violet 23 | 10.5/Pensize 730 | 44.6 | 82 | 4-5+/5 | 5/5 |
| 100 | 14/Violet 23 | 21/Pensize 730 | 36.7 | 129 | 4-5+/5 | 5/5 |
| 101 | 21/Violet 23 | 31.5/Pensize 730 | 32.1 | 142 | 4-5+/5 | 5/5 |
| 102 | 8/Blue 15:1 | None | 46.3 | 100 | 3/4-5 | 5/5 |
| 103 | 4/Blue 15:1 | 2.5/Polymer A | 47.3 | 62 | 4-5+/5 | 5/5 |
| 104 | 8/Blue 15:1 | 5/Polymer A | 44.4 | 99 | 4-5+/5 | 5/5 |
| 105 | 16/Blue 15:1 | 10/Polymer A | 37.9 | 140 | 4-5+/5 | 5/5 |
| 106 | 24/Blue 15:1 | 15/Polymer A | 35.9 | 175 | 4-5+/5 | 5/5 |
| 107 | 4/Blue 15:1 | 5/Pensize 730 | 44.2 | 41 | 4-5+/5 | 5/5 |
| 108 | 8/Blue 15:1 | 10/Pensize 730 | 39.3 | 72 | 4-5+/3-4+ | 5/5 |
| 109 | 16/Blue 15:1 | 20/Pensize 730 | 32.3 | 124 | 4-5+/4 | 5/5 |
| 110 | 24/Blue 15:1 | 30/Pensize 730 | 29.9 | 176 | 4-5+/5 | 5/5 |
| 111 | 7/Red 2 | None | 42.9 | 100 | 3-4/4+ | 5/5 |
| 112 | 3.5/Red 2 | 2.1/Polymer A | 45.2 | 62 | 5/5 | 5/5 |
| 113 | 7/Red 2 | 4.2/Polymer A | 41.3 | 99 | 5/5 | 5/5 |
| 114 | 14/Red 2 | 8.4/Polymer A | 36.9 | 141 | 5/5 | 5/5 |
| 115 | 21/Red 2 | 12.6/Polymer A | 33.1 | 173 | 5/5 | 5/5 |
| 116 | 3.5/Red 2 | 5/Pensize 730 | 41.3 | 49 | 5/5 | 5/5 |
| 117 | 7/Red 2 | 10/Pensize 730 | 38.1 | 89 | 5/5 | 5/5 |
| 118 | 14/Red 2 | 20/Pensize 730 | 31.4 | 148 | 5/5 | 5/5 |
| 119 | 21/Red 2 | 30/Pensize 730 | 26.8 | 200 | 5/5 | 5/5 |

[1]to[4], see footnotes at end of Table 1

Again the advantages of Polymer A are especially apparent at low concentrations when compared to Pensize 730.

The invention claimed is:

1. A composition comprising:

a) from 0.1 to 30% by weight, based on the total weight of the composition, of a colouring pigment, b) from 0.1 to 20% by weight, based on the total weight of the composition of a starch/latex copolymer, c) from 0 to 20% by weight, based on the total weight of the composition, of starch or a starch derivative, d) from 0 to 10% by weight, based on the total weight of the composition, of one or more auxiliaries and e) water to complete to 100% by weight, based on the total weight of the composition, wherein the starch/latex copolymer is obtained by copolymerization of:

i) from 20 to 40% by weight of a styrene or a substituted styrene, ii) from 20 to 50% by weight of an acrylate or a methacrylate and iii) from 5 to 20% by weight of one or more further ethylenically unsaturated monomers, in the presence of from 15 to 40% by weight of starch, wherein the further ethylenically unsaturated monomer is selected from the group consisting of: alkyl vinyl ketones, a substituted acrylamide, a methacrylic acid, crotonic acid, itaconic acid, fumaric acid, maleic acid, maleic anhydride, a vinyl halide, vinylidene halide, a vinyl ester, a vinyl ether, vinyl carbazole, N-vinyl pyrrolidone, vinyl pyridine, ethylene, propylene, isobutylene, vinyl acetate, acrylic acid, and a monovinyl silicon compound.

2. The composition according to claim 1, in which the colouring pigment is selected from the group consisting of pigments disclosed in the Colour Index International under the designations C.I. Pigment Yellows 1 to 221, C.I. Pigment Oranges 1 to 81, C.I. Pigment Reds 1 to 283, C.I. Pigment Violets 1 to 53, C.I. Pigment Blues 1 to 81, C.I. Pigment Greens 1 to 56, CI Pigment Browns 1 to 47 and C.I. Pigment Blacks 1 to 35.

3. The composition according to claim 1, wherein the starch component of the starch/latex copolymer is a degraded, oxidized anionic starch.

4. The composition according to claim 1, in which the starch/latex copolymer is in the form of an aqueous dispersion having a dry content of from 20 to 50% by weight.

5. The composition according to claim 1, wherein the auxiliaries are selected from the group consisting of fixing agents, dispersants, binder resins, insolubilizing and/or cross linking agents, anionic, cationic and neutral polymers, wet-strength agents, antifoams and biocides.

6. A method for the surface colouration of paper by applying to the paper surface a composition comprising:

a) from 0.1 to 30% by weight, based on the total weight of the composition, of a colouring pigment, whereby the colouring pigment is in solid form or in the form of a dispersion, b) from 0.1 to 20% by weight, based on the total weight of the composition of a starch/latex copolymer, c) from 0 to 20% by weight, based on the total weight of the composition, of starch or a starch derivative, d) from 0 to 10% by weight, based on the total weight of the composition of one or more auxiliaries and e) water to complete to 100% by weight, based on the total weight of the composition, wherein the starch/latex copolymer is obtained by copolymerization of i) from 20 to 40% by weight of a styrene or a substituted styrene, ii) from 20 to 50% by weight of an acrylate or a methacrylate, and iii) from 5 to 20% by weight of one or more further ethylenically unsaturated monomers, in the presence of from 15 to 40% by weight of starch, wherein the further ethylenically unsaturated monomer is selected from the group consisting of: alkyl vinyl ketones, a substituted acrylamide, a methacrylic acid, crotonic acid, itaconic acid, fumaric acid, maleic acid, maleic anhydride, a vinyl halide, vinylidene halide, a vinyl ester, a vinyl ether, vinyl carbazole, N-vinyl pyrrolidone, vinyl pyridine, ethylene, propylene, isobutylene, vinyl acetate, acrylic acid, and a monovinyl silicon compound.

7. Paper, which has been treated with a composition according to claim 1.

8. Paper which has been treated with a composition according to the method according to claim 6.

9. The composition according to claim 2, wherein the starch component of the starch/latex copolymer is a degraded, oxidized anionic starch.

* * * * *